US006076187A

United States Patent [19]

Wallerstein

[11] Patent Number: 6,076,187

[45] Date of Patent: Jun. 20, 2000

[54] ELACTICIZED FORM FITTING SHIRT

[76] Inventor: Robert Wallerstein, 9782 Tottenham Ct., Los Angeles, Calif. 90210

[21] Appl. No.: 09/079,399

[22] Filed: May 15, 1998

[51] Int. Cl.[7] ..... A41B 1/00

[52] U.S. Cl. ..... 2/115

[58] Field of Search ..... 2/115, 116, 106, 2/113, 118

[56] References Cited

U.S. PATENT DOCUMENTS 1,112,387 9/1914 Schneer .
1,226,654 5/1917 Gordon .
1,786,105 12/1930 Clark .
2,418,774 4/1947 Katz .

*Primary Examiner*—John J. Calvert
*Assistant Examiner*—Shirra L. Jenkins
*Attorney, Agent, or Firm*—Larson & Taylor, PLC

[57] ABSTRACT

A man's shirt is provided which is made of conventional woven non-stretch shirting material but which includes elastic elements woven therein at the shirt sides in the area of the torso. These elastic elements shape and sculpt the shirt in this area and prevent bunching and creasing of the shirt. A related method begins with a bolt of a basic shirting material with discrete sites at which the elastic elements are provided and uses computer-controlled cutting of the shirting material relative to these sites to provide component parts of the shirt which, when assembled together with other component parts, produce a shirt with designed-in shaping.

4 Claims, 3 Drawing Sheets

ELACTICIZED FORM FITTING SHIRT

FIELD OF THE INVENTION

The present invention relates to men's shirts and, more particularly, to a shirt in which side portions thereof are elasticized, i.e., fabricated of resilient stretch material or otherwise constructed so as to follow the form of the wearer without necessarily clinging to the body and so as to conform to the sides of a wearer to provide a smooth fit.

BACKGROUND OF THE INVENTION

There are, of course, many garments or items of apparel which cling to and sculpt the body of the wearer including foundation garments, body suits made of Spandex or the like and even tight fitting knits. Other garments have a backing of elastic but this tends to create creases and wrinkles. In addition to these garments, there are many other garments which contain elastic or the like for this and various other purposes. Examples of the latter are found in the following U.S. Patents: U.S. Pat. No. 1,786,105 (Clark); U.S. Pat. No 1,226,654 (Gordon); U.S. Pat. No. 2,418,774 (Katz); U.S. Pat. No. 5,105,478 (Pyc); U.S. Pat. No. 1,112,387 (Schneer); and U.S. Pat. No. 2,803,014 (Beach). Briefly considering these patents, the Clark patent discloses a "stay-down shirt" containing two elastic bands located at the waist of the shirt. The elastic bands go completely around each side of the shirt and are joined in the back by strings. The strings can be drawn in, pulling the bands together, to make the shirt fit snugly. The elastic is attached to the inside of the shirt so it is not visible. The shirt is attached to the elastic so that only the back portion stretches. The Gordon patent discloses a boy's blouse with a short band of elastic located along the back hem. The elastic band replaces the bottom button and buttonhole in the shirt and makes bottom of the shirt fit snugly. The Katz patent discloses to a non-blousy mans shirt with an elastic belt to prevent the shirt from riding up. The front portion of the shirt is cut in a V-shape extending below the waist while the back is cut in a inverted V-shape. The elastic is sewn around the entire waist of the shirt, leaving the fabric in the front extending below the elastic. The elastic is intended to be located below the pants waistline and therefore not to be visible. The Pyc patent discloses a shirt with mesh inserts for ventilation. The inserts are located under the arms, in the body and sleeve of the shirt. The mesh fabric allows increased ventilation inside the shirt. The Schneer patent discloses a boy's blouse with a detachable elastic strap. The elastic is connected to the back hem of the shirt with three buttons and can be removed for washing or adjusted for very small sizes. The elastic is designed to give a fitted effect at the bottom of the shirt. The Beach patent discloses inserts for the armholes of women's and children's sleeveless dresses and shirts. A triangular section of stretching fabric prevents gaping and gives the article a fitted appearance under the arm.

SUMMARY OF THE INVENTION

In general, in accordance with the invention, a non-stretch shirt is provided which includes elastic means in areas adjacent to the sides of shirt so as to enable a manufacturer of the shirt to sculpt the shape of the shirt to the body of the wearer without the need for conventional "mechanical" tailoring, and to enhance the fit of the shirt as well as to provide added wearer comfort.

In accordance with a preferred embodiment of the invention, the basic shirt is woven from a standard non-stretch shirting material such as cotton or the like but, in addition, has visually matching elastic elements or threads woven thereon in the side and other regions where excess material is normally needed to accommodate the girth and movement of a wearer. Advantageously, the amount of elastic material is varied in a graduated manner approaching the sides of the shirt and is reduced (or even eliminated) at the sides. In this way, the shape of the shirt can be made to approximate, and conform to, the body silhouette but in a way that the shirt does not have the appearance of a spandex body suit or a shirt made of a stretch fabric. Thus, the shirt of the invention has the appearance, when worn, of a perfectly tailored cotton shirt that is free of creases but at the same time can place emphasis on selected body regions and will not bunch at the waist and will stretch to accommodate the movements of the wearer. It will be appreciated that this "disguising" or hiding of the elastic means is a key feature of the invention.

In accordance with a further preferred embodiment of the invention, panels of spandex cotton blend are inserted into the sides of the shirt, e.g., by sewing. In one advantageous implementation, the panel comprises a single strip of material extending along a side seam of the shirt or otherwise running along the side of the shirt. A flap is preferably provided which covers the strip to hide the strip from view. In another implementation, the elastic panel may comprise an inverted wedge although, at present, this implementation is less preferred because, depending on how well the panel can be matched to the remainder of the shirt, the modification could highlight the modification and may interfere with designing of the shirt by the manufacturer.

According to a further aspect of the invention, a method of producing a shirt is provided which affords a shirt designer with flexibility in creating a shirt design and which results in a shirt having the desirable characteristics and advantages discussed above. In general, the method comprises: providing non-stretch shirting material having elastic elements woven therein as part of a repeating pattern at predetermined sites (e.g., as specified by the shirt designer to the weaver), marking the cutting locations by visual or other means at the same time the material is woven; cutting the material at the marked locations into component parts of the shirt to be produced at the marked locations, so that when the component parts of the shirt are assembled, the elastic elements of the material of the shirt provide built-in shaping of the shirt at the sides of the shirt in the area of the torso; and assembling the component parts to produce a shirt having said shaping.

Advantageously, the cutting of the material is controlled by a computer and the method further comprises providing computer targets, preferably in the form of optical markers, in the shirting material for assisting the computer in control of the cutting operation.

Other features and advantages of the invention will be set forth in, or apparent from, the following detailed description of preferred embodiments of the invention.

DESCRIPTION OF THE PREFERRED EMBODIMENTS

Figure 2:
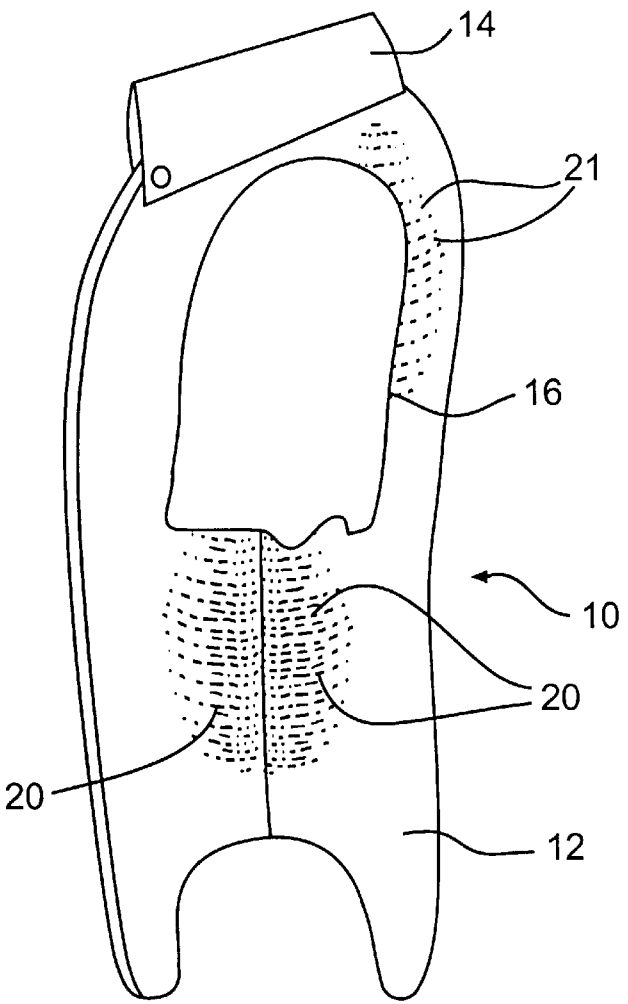
FIG. 2 is a side elevational view of the shirt of FIG. 1.
Figure 1:
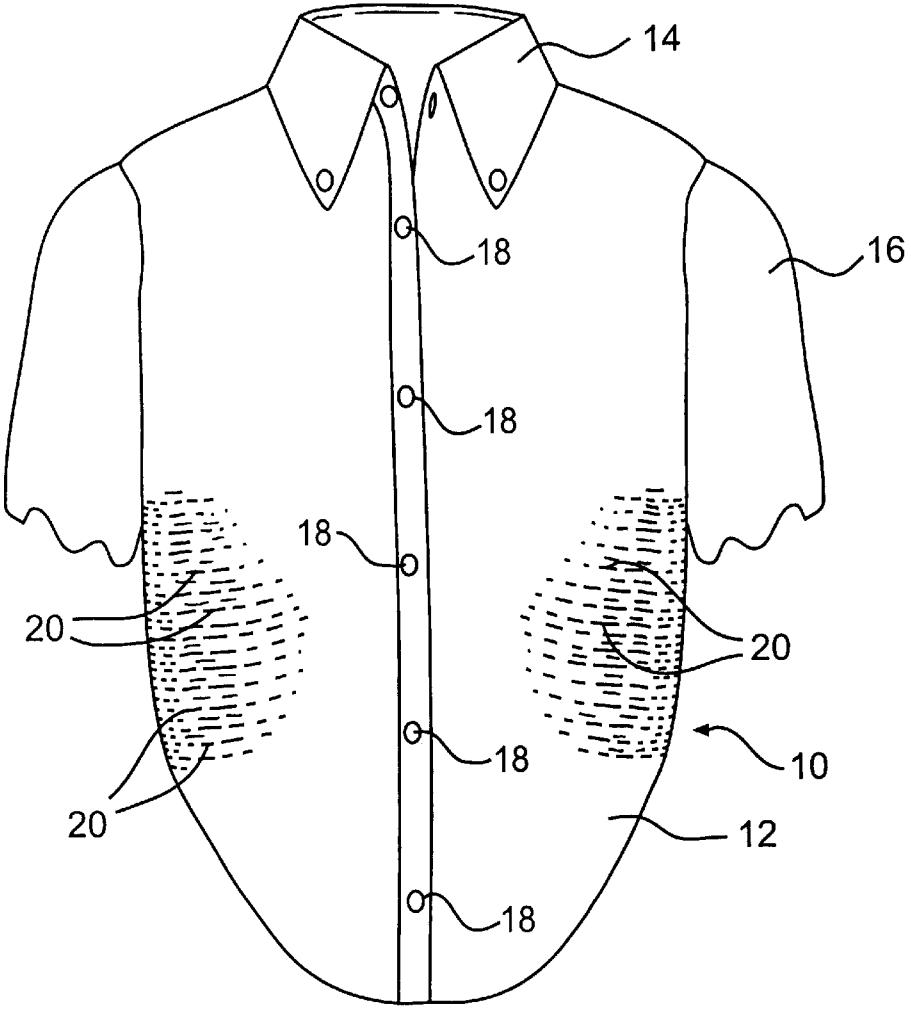
FIG. 1 is a front elevational view of a man's shirt made or constructed in accordance with a preferred embodiment of the invention.

Referring to FIGS. 1 and 2, there is shown a presently preferred embodiment of the shirt of the invention. As discussed above, the shirt, which is generally denoted 10, has the overall outward appearance of a standard shirt. In this case, the shirt 10 is a button down dress shirt including a body portion 12, a collar 14 and sleeves 16 (which are broken away to simplify the drawings) and is closed in front by a row of buttons 18, but the shirt could, of course, be of any style.

In accordance with the presently preferred embodiment of the invention illustrated in FIGS. 1 and 2, the side portions of shirt 10 are elasticized by a plurality of elastic elements 20 (e.g., threads or fibers) woven therein. The elastic or stretchable elements 20 are concentrated at the lower sides, i.e., at the waist sides, of the shirt, and are preferably woven into the basic shirting material in a graduated pattern so as to blend in with the basic shirt and thus be inconspicuous. In other words, as illustrated in FIGS. 1 and 2, the conventration of elastic or stretchable elements is greatest in an area adjacent to, but spaced from, the sides and decreases outwardly therefrom in a graduated manner. Moreover, as illustrated, the shirt lies flat, or non-gathered, in region of elements 20. Although elastic elements 20 are indicated as being horizontal in FIGS. 1 and 2, it will be understood that the elastic elements can extend vertically or even diagonally or in another direction or in a combination of such directions. Modern weaving techniques, using computer controlled and generated patterns, permit this to be readily accomplished.

Although the invention is particularly concerned with providing shaping at the sides of the waist or lower torso of a wearer, elastic elements can also be provided at the upper back, i.e., in the region or area of the latissimus dorsi, as indicated by elements 21 in FIG. 2.

Figure 3:
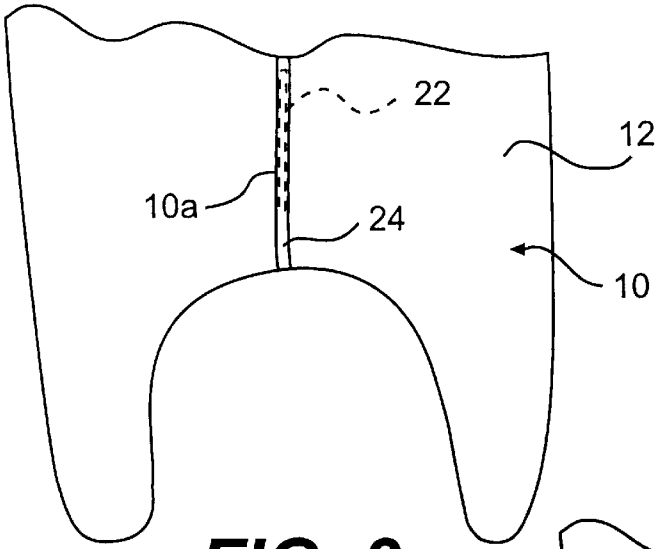
FIG. 3 is a partially broken away side elevational view of a further embodiment of the invention.

Referring to FIG. 3, a further embodiment of the invention is shown. In this embodiment, the stretchable or elastic means comprises a simple elastic strip extending along a side seam 10*a* of shirt 10. Preferably, strip 22 is covered by flap 24 which extends along seam 10*a* so that strip 22 is hidden from view.

Figure 4:
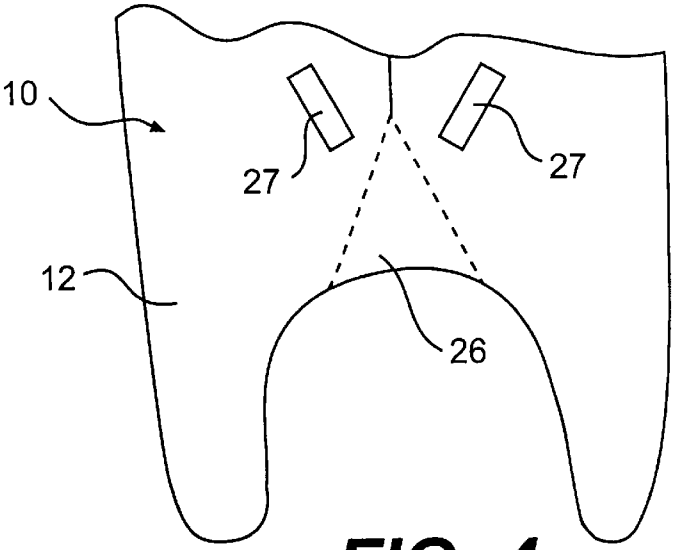
FIG. 4 is partially broken away side elevational view of another embodiment of the invention.
Figure 5:
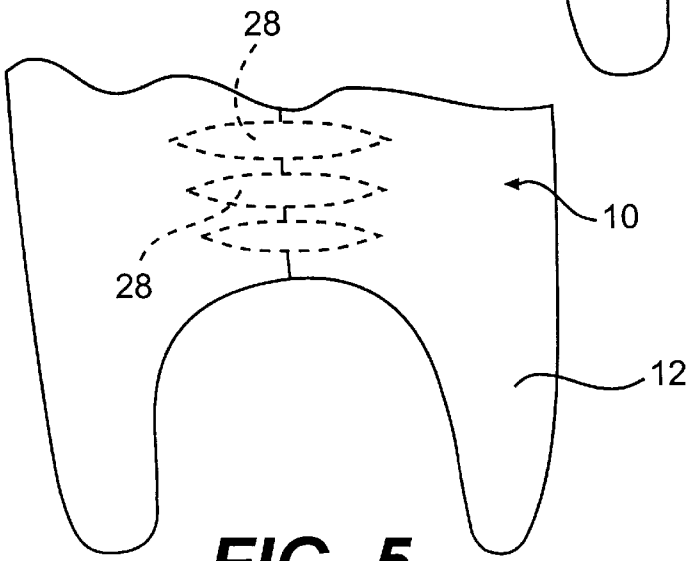
FIG. 5 is a partially broken away side elevational view of yet another embodiment of the invention.

Referring to FIGS. 4 and 5, two further embodiments of the invention are shown. In FIG. 4, the elastic means comprises an inverted wedge-shaped panel 26 of an elastic material such as cotton spandex. Further elastic strips or panels are provided at 27, adjacent to the side seam. This embodiment is presently less preferred than that of FIGS. 1 and 2 but could be used to extent that panel 26 (and strips 27) can be made to appear to be an integral part of the basic shirting material and does not highlight the modifications of the shirt. In FIG. 5, a series a spaced transversely extending strips or panels 28 are used to elasticize the side waist area of shirt 10. Again, the efficacy of this embodiment depends on the extent that the panels can be disguised as being part of the shirting material or otherwise made not to be noticeable.

While it is contemplated that a shirt in accordance with the preferred embodiments of the invention would be in the nature of a dress shirt or the like, the invention is applicable to sport shirts as well and in such applications the elastic strips or panels could be disguised as part of the markings or ornamentation on the shirt. Further, the general principles of the invention are also application to other garments wherein similar considerations apply.

Figure 6:
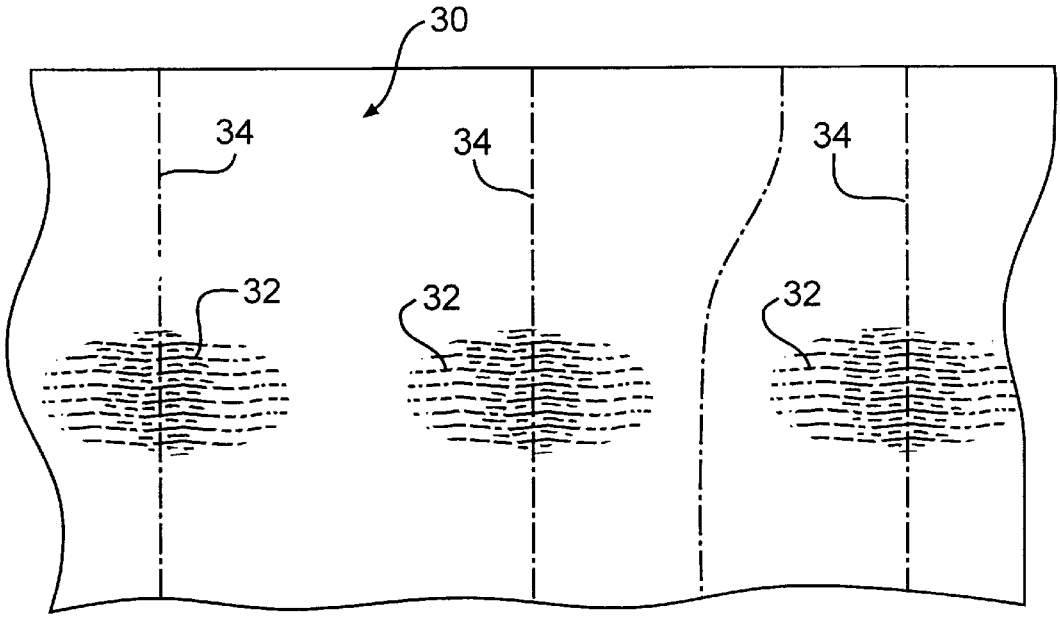
FIGS. 6 and 7 are schematic top plan views, partially broken away, of examples of shirting material employable in the method of the invention.
Figure 7:
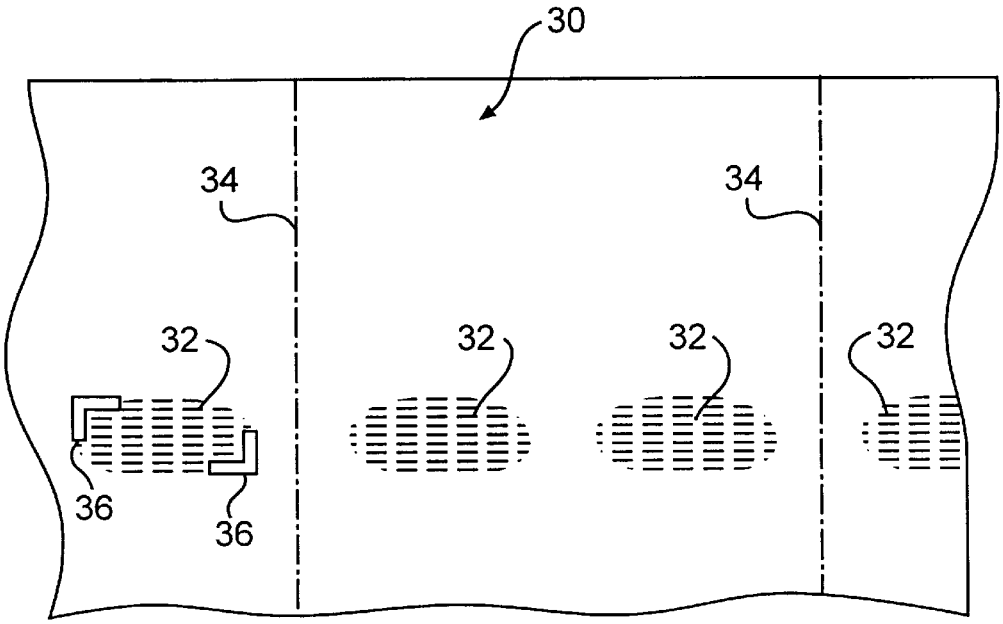

Referring to FIGS. 6 and 7, according to a further aspect of the invention, a method is provided of making a shirt having the characteristics discussed above wherein the shirting material itself provides the ultimate shaping of the shirt. As illustrated in the very simple examples shown in FIGS. 6 and 7, the basic cloth or shirting material, denoted 30, from which the shirt is to be made is provided with a plurality of discrete sites or regions of elastic elements, denoted 32. The regions 32 can be of different shapes, graduated densities and spacings and, as stated, FIGS. 6 and 7 show very simple examples. This arrangement enables the material to be cut along cutlines, chosen by the shirt designer and indicated, for example, at 34 in FIGS. 6 and 7, in a manner so as to produce component panels or parts of the shirt which, when assembled with other component panels or parts, place the elastic portions at locations which provide the desired shaping. Because, ideally, the areas 32 will be indistinguishable visually from the other areas of the basic shirting material, computer targets are preferably provided so as to indicate the elasticized areas 32 to the computer which is controlling the cutting operation. These targets preferably take the form of optical markers which are not visible to the naked eye and may be contained in predetermined threads woven into the basic shirting material. Two such markers are indicated at 36 in FIG. 7 for the first (left-most) elasticized area 32. However, visual markers could also be used as could magnetic and other markers.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A shirt comprising:

a body portion fabricated of a shirting material and including opposite sides;

a collar portion, joined to the body portion, through which the head of a wearer extends; and a pair of sleeves joined to the body portion for receiving the arms or a wearer, said body portion including predetermined areas having increased elasticity over the remaining portions of the shirt, the increased elasticity being provided by a plurality of threads of an elastic material woven into otherwise non-elastic shirting material in said predetermined areas, and said shirt presenting a conventional appearance throughout including said predetermined areas.

2. A shirt as claimed in claim 1 wherein said predetermined areas are located at both sides of the body portion.

3. A shirt as claimed in claim 2 wherein the number of said threads of elastic material varies in a graduated pattern in the regions of said sides so as to provide blending of the threads of elastic material with threads of the shirting material and to provide maximum number of threads in an area adjacent to but spaced from the sides so as to maintain a predetermined shape when the shirt is worn.

4. A shirt as claimed in claim 2 wherein said threads of an elastic material are woven into the shirting material at further predetermined areas at the upper back of wearer.

* * * * *